US007556046B2

(12) United States Patent
Koga et al.

(10) Patent No.: US 7,556,046 B2
(45) Date of Patent: Jul. 7, 2009

(54) METHOD OF REDUCING NITROSAMINES CONTENT IN TOBACCO LEAVES

(75) Inventors: Kazuharu Koga, Oyama (JP); Satoshi Katsuya, Oyama (JP)

(73) Assignee: Japan Tobacco Inc., Tokyo (JP)

( * ) Notice: Subject to any disclaimer, the term of this patent is extended or adjusted under 35 U.S.C. 154(b) by 518 days.

(21) Appl. No.: 10/981,684

(22) Filed: Nov. 5, 2004

(65) Prior Publication Data

US 2005/0115576 A1 Jun. 2, 2005

Related U.S. Application Data

(63) Continuation of application No. PCT/JP03/05845, filed on May 9, 2003.

(30) Foreign Application Priority Data

May 10, 2002 (JP) ..... 2002-135777

(51) Int. Cl.
*A24B 3/10* (2006.01)

(52) U.S. Cl. ..... 131/290

(58) Field of Classification Search ..... 131/290; 800/317.3

See application file for complete search history.

(56) References Cited

U.S. PATENT DOCUMENTS 4,011,141 A 3/1977 Gravely et al.
4,151,848 A * 5/1979 Newton et al. ..... 131/352
4,556,073 A 12/1985 Gravely et al.
4,557,280 A * 12/1985 Gravely et al. ..... 131/297
4,566,469 A * 1/1986 Semp et al. ..... 131/308
4,622,982 A * 11/1986 Gaisch et al. ..... 131/297
4,709,710 A * 12/1987 Gaisch et al. ..... 131/308
5,803,081 A * 9/1998 O'Donnell et al. ..... 131/299
5,810,020 A * 9/1998 Northway et al. ..... 131/297
6,564,808 B1 * 5/2003 Hempfling et al. ..... 131/297
2006/0225750 A1 10/2006 Koga et al.
2006/0225751 A1 10/2006 Koga et al.

FOREIGN PATENT DOCUMENTS

JP 5-252928 A 10/1993
JP 9-194316 7/1997

OTHER PUBLICATIONS

L. L. Parsons et al., Tobaco International, Tobacco Science, vol. 188, No. 18, 1986, pp. 48-51.
Programme and Abstracts of 2006 Coresta Congress, AP16 (pp. 73-74).

* cited by examiner

*Primary Examiner*—Carlos Lopez
(74) *Attorney, Agent, or Firm*—Birch, Stewart, Kolasch & Birch, LLP

(57) ABSTRACT

A method of reducing the content of TSNA in tobacco leaves, comprising treating tobacco leaves with a microorganism which has the capability to reduce TSNA and which is selected from the group consisting of *Sphingomonas paucimobilis* and *Pseudomonas fluorescens*.

9 Claims, No Drawings

METHOD OF REDUCING NITROSAMINES CONTENT IN TOBACCO LEAVES

CROSS-REFERENCE TO RELATED APPLICATIONS

This is a Continuation Application of PCT Application No. PCT/JP03/05845, filed May 9, 2003, which was published under PCT Article 21(2) in Japanese.

This application is based upon and claims the benefit of priority from prior Japanese Patent Application No. 2002-135777, filed May 10, 2002, the entire contents of which are incorporated herein by reference.

BACKGROUND OF THE INVENTION

1. Field of the Invention

The present invention relates to a microorganism which degrades nitrosamines formed in tobacco leaves during the curing and storage processes of the tobacco leaves, and a method of reducing nitrosamines formed in tobacco leaves during the curing process and/or storage process thereof, by using the microorganism.

2. Description of the Related Art

Nitrosamines contained in tobacco leaves (Tobacco Specific Nitrosamines, which will be referred to as "TSNA" hereinafter), are not present in tobacco leaves immediately after harvesting (i.e., green leaves), but formed during the curing process and storage process thereafter by a reaction between alkaloids and nitrite contained in the tobacco leaves. This nitrite is formed by a microorganism which is present at the surface of the tobacco leaf and which has the capability to reduce nitrate.

The main TSNA formed in the curing process and the subsequent storage process are N'-nitrosonornicotine (which will be referred to as "NNN" hereinafter), 4-(N-nitrosomethylamino)-1-(3-pyridyl)-1-butanone (which will be referred to as "NNK" hereinafter), N'-nitrosoanatabine (which will be referred to as "NAT" hereinafter), N'-nitrosoanabasine (which will be referred to as "NAB" hereinafter), and the like.

Examples of the method which has been conventionally known as a method of reducing the content of TSNA in tobacco leaves include: (1) a method of suppressing formation of TSNA; and (2) a method of removing TSNA which has been formed.

Examples of the method of suppressing formation of TSNA include: a method of decreasing the content of alkaloids in tobacco leaves by reducing the amount of nitrogenous fertilizer; a method of reducing TSNA formed during the curing process, by adopting an indirect-heating type of curing barn in place of a direct-heating type of curing barn (this method is employed mainly for flue-cured tobacco); a method of breeding a new tobacco varieties having less alkaloid content, which method relies on progress of the breeding technology; and the like.

Further, a method has recently been reported in which formation of TSNA is suppressed by microwave irradiation (PCT National Publication No. 2001-503247). However, such rapid drying and curing as caused by the aforementioned treatment with microwaves results in insufficient change in the type of components of the tobacco leaves, which change would be effected in a satisfactory manner in the conventional curing process. Thereby, the resulting tobacco leaves which have been cured more rapidly than by the conventional method exhibits poor flavor and taste when smoked.

In the case of the method of removing TSNA (thus formed) from tobacco leaves, the number of reported examples thereof is smaller than the method of suppressing formation of TSNA. As one of these examples, a method is known in which TSNA is removed from tobacco leaves by supercritical extraction (WO 01/65954). However, this method has not been put to practical use in terms of the cost thereof.

Due to the above-described circumstances, there has been a demand for a novel method of reducing the content of TSNA which is known to be formed during the curing and storage processes of tobacco leaves.

Further, there has been a demand for tobacco leaves, as the raw material of cigarettes, which have relatively less content of TSNA and maintain good flavor and taste satisfactory to consumers.

Accordingly, the object of the present invention is to provide a method which enables reducing the content of TSNA formed during the conventional curing and storage processes.

Additionally, it is already known that a micro-organism belonging to genus *Aspergillus* which is a filamentous fungus isolated from unrefined soy source degrades nitrosamines (Jpn. Pat. Appln. KOKAI Publication No. 10-276681). However, it has been pointed out that microorganisms which belong to genus *Aspergillus* need high moisture content for survival, which high moisture content may cause adverse effects on the quality of tobacco leaves, especially on the flavor and taste thereof. Therefore, use of such a microorganism as described above in the treatment of tobacco leaves may cause a problem in tobacco quality.

BRIEF SUMMARY OF THE INVENTION

According to a first aspect of the present invention, there is provided a method of reducing the content of TSNA in tobacco leaves, characterized by comprising treating tobacco leaves with a microorganism which has the capability to reduce TSNA and which is selected from the group consisting of *Sphingomonas paucimobilis* and *Pseudomonas fluorescens*.

According to a second aspect of the present invention, there is provided a method of reducing the content of TSNA in tobacco leaves, characterized by comprising treating tobacco leaves with a microorganism selected from the group consisting of *Sphingomonas paucimobilis* LG5 strain and *Pseudomonas fluorescens* LG38 strain.

According to a third aspect of the present invention, there is provided a microorganism which belongs to *Sphingomonas paucimobilis* or *Pseudomonas fluorescens* and which has the capability to reduce the content of at least one type of TSNA in tobacco leaves that is selected from the group consisting of N'-nitrosonornicotine, 4-(N-nitrosomethylamino)-1-(3-pyridyl)-1-butanone, N'-nitrosoanatabine and N'-nitrosoanabasine, wherein these are formed during the curing and storage processes of the tobacco leaves.

According to a fourth aspect of the present invention, there is provided a *Sphingomonas paucimobilis* LG5 strain (FERM BP-7830) which is capable of reducing the content of TSNA in tobacco leaves.

According to a fifth aspect of the present invention, there is provided a *Pseudomonas fluorescens* LG38 strain (FERM BP-7831) which is capable of reducing the content of TSNA in tobacco leaves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

As a result of study and analysis of the formation process of TSNA during the curing and storage of tobacco leaves, the inventors of the present invention have discovered that there exists a microorganism which can degrade TSNA, among the microorganisms present on tobacco leaf, thereby completing the present invention.

While the inventors of the present invention were analyzing the formation process of TSNA in tobacco leaves which were being cured, they isolated a microorganism which can degrade the formed TSNA, from the microorganisms present on tobacco leaves. Further, the inventors of the present invention discovered that the content of TSNA in tobacco leaves can be reduced by treating, with the microorganism, the tobacco leaves which are being cured and/or the tobacco leaves which are to be stored after the curing process.

The two types of microorganisms which exhibit especially high degradation activity among the isolated (collected) microorganisms have been identified, on the basis of bacteriological characteristics thereof, as *Sphingomonas paucimobilis* and *Pseudomonas fluorescens*, respectively. The inventors of the present invention named the strain of *Sphingomonas paucimobilis "LG5"* (which will be referred to as "LG5" or "LG5 strain" hereinafter), and the strain of *Pseudomonas fluorescens* "LG38" (which will be referred to as "LG38" or "LG38 strain" hereinafter). LG5 has been deposited as accession number FERM BP-7830 and LG38 has been deposited as accession number FERM BP-7831, respectively, with Dec. 18, 2001, under International Patent Organism Depositary (IPOD), National Institute of Advanced Industrial Science and Technology (AIST Tsukuba Central 6, 1-1 Higashi 1-chome, Tsukuba-shi, Ibaraki-ken, Japan).

These microorganisms LG5 and LG38 effectively reduce TSNA in tobacco leaves without causing any adverse effect on the quality of the tobacco leaves which are being cured and/or the tobacco leaves in storage.

Further, according to the method of the present invention, reduction of the content of TSNA can be achieved simply by treating tobacco leaf with the microorganism, without changing the conventional method of curing. Thus, the quality, flavor and taste of the present tobacco leaf can be reliably maintained.

The activity of strains LG5 and LG38 are as follows.

LG5 has the activity of specifically degrading NNK. LG38 has the activity of degrading NNN, NNK, NAT and NAB.

Tobacco leaf to be treated according to the present invention may be any tobacco, as long as the tobacco allows the conventional curing operation. Specific examples thereof include Burley tobacco and Japanese domestic tobacco as an air-cured type, and flue-cured tobacco that is cured with an apparatus, with no restriction thereto.

The time when tobacco leaf is treated with the microorganism according to the present invention is not particularly restricted, and the treatment may be carried out anytime in a period from the time immediately before TSNA is formed in tobacco leaf to the time when tobacco leaf is processed into cigarettes. The treatment is preferably carried out in a period during which tobacco leaf is cured and/or a period during which tobacco leaf is stored. In a case in which the treatment is carried out in the curing process, the treatment is preferably carried out in a period from the time immediately after harvest, which is the time before TSNA is formed, to the time of yellowing stage and browning stage. However, the treatment may be carried out anytime in the curing process. In a case in which the treatment is carried out in the storage process, the treatment is preferably carried out when storage is started after the curing process, although the treatment may be carried out anytime during the storage period. The time when the treatment is carried out can basically be selected by an operator, as desired, in a period from the time when the curing process is started to the time when the storage process is completed.

Alternatively, it is acceptable that tobacco leaf is treated with the microorganism in the field immediately before harvest and then harvested and cured.

The number of times of the treatment with the microorganism according to the present invention is not limited to one time. The treatment may be carried out plural times consecutively in the treatment period, with a predetermined interval between each treatment.

The treatment in the present invention is not limited to the treatment during the curing and/or storage processes, and the treatment may be carried out in a process during which tobacco leaf is processed into cigarettes.

The treatment according to the present invention may be carried out by any of known methods, examples thereof include spraying of suspension in which the microorganism is suspended and coating of powder containing bacterial cells of the microorganism. That is, an operator may select an appropriate method for the treatment. It is also acceptable to immerse tobacco leaf in a liquid containing the microorganism.

As described above, the microorganism which is preferably used in the present invention is LG5 strain and LG38 strain. However, the present invention is not restricted to these strains. Any microorganism species which belongs to *Sphingomonas paucimobilis* or *Pseudomonas fluorescens* and which has the capability to reduce TSNA is included within the scope of the present invention.

In the present specification, the term "to reduce TSNA" represents reducing the content of TSNA in tobacco leaf. For example, to degrade each of the TSNA components in tobacco leaf formed during the curing and storage processes thereof is included in the term "to reduce TSNA".

As a culture medium for culturing the micro-organism used in the present invention, various types of known culture medium for culturing microorganisms can be used.

With regard to the culturing conditions under which the microorganism is cultured, the temperature can be in a range of 25 to 35° C., preferably in a range of 28 to 32° C., and pH can be in a range of 6.0 to 8.0, preferably 7.0 or so.

In the present invention, the microorganism is collected by centrifuging, after cultured for a predetermined period. The collected bacterial cells may be used after being suspended in a buffer. Alternatively, the collected bacterial cells may be used in powder form by freeze-drying.

In a case in which the collected bacterial cells are suspended in a specific buffer to prepare the microorganism suspension, sterilized distilled water, phosphate buffer or the like can be used as the buffer.

The concentration of the bacterial cells suspended in a buffer can be $10^7$ to $10^{12}$, preferably $10^8$ to $10^{10}$ cells per 1 ml of the buffer. It is preferable that the bacterial cells are suspended in such a concentration as described above when used for the treatment of tobacco leaf with the microorganism.

According to the present invention, the treatment of tobacco leaf with the microorganism can be carried out by using the bacterial cells obtained as described above.

An inoculation solution of the microorganism for inoculating into tobacco leaf is prepared by adding sterilized distilled water to bacterial suspension containing the necessary amount of the bacterial cells. Thus prepared inoculation solution is evenly sprayed on tobacco leaf. This treatment can be carried out anytime within the period from the curing process to the storage process. In a case of using air-cured tobacco, the treatment may be carried out anytime during the curing process and the storage period thereafter. In a case of using flue-cured tobacco, the treatment is carried out at the initial stage of the curing process (the yellowing stage) or in the storage process after the curing process. It is preferable that the treatment is carried out at the yellowing stage in the curing process. In the case of air-cured tobacco, it is preferable that the treatment is carried out at the browning stage in the curing process.

With regard to the amount of the inoculation solution to be sprayed, when the treatment is carried out immediately after harvest or at the initial stage of the curing process, 2 to 10 ml of the inoculation solution is applied per one piece of tobacco leaf. When the treatment is carried out at an intermediate stage of the curing process or thereafter, 0.5 to 3 ml of the inoculation solution is applied per one piece of tobacco leaf.

With regard to the number of times of the treatment, it suffices that the treatment is carried out at least once during the curing and/or storage processes. It is preferable that the treatment is carried out two to three times during the curing and/or storage processes, with an interval between each treatment.

According to the aspects of the present invention, no significant change is brought into the curing condition except that tobacco leaf is treated with the microorganism, and therefore it is possible to reduce the content of TSNA without causing an adverse effect on the natural flavor and taste of the tobacco leaf.

EXAMPLES

Example 1

1) Isolation of the microorganism from tobacco leaves

Microorganisms were collected from tobacco leaves grown in a tobacco field in Oyama-shi, Tochigi prefecture.

The microorganisms were collected three times, i.e., immediately after the harvest of tobacco leaves, on day 3 in the curing period (that is, when the change in color of the leaves to yellow was completed), and on day 8 in the curing period (that is, when the change in color of the leaves to brown was completed).

The leaf stalk position of Michinoku 1, which is Burley tobacco, were harvested, and portions of lamina of the harvested tobacco leaves were cut off as samples. The samples thus obtained were finely cut to 5 mm×5 mm squares. Approximately 10 g of the samples thus cut was put into a 300 ml Erlenmeyer flask. 200 ml of 10 mM phosphate buffer (pH: 7.0) was added thereto, and the mixture was homogenized. The suspension thus obtained was used as "the harvest-time suspension" containing microorganisms derived from tobacco leaves at the time of harvest.

Collection of microorganisms from tobacco leaves in the curing period (i.e., collection on day 3 in the curing process when the change to yellow color was completed; and collection on day 8 in the curing process when the change to brown color was completed) was carried out, using the tobacco leaves which have been harvested as described above and then brought into the curing process, in a manner similar to that in collection of microorganisms at the harvest stage. Specifically, the leaf stalk position of Michinoku 1 harvested as described above was hung in a steel pipe house, which is a conventional curing barn for air-cured tobacco. On day 3 and day 8 thereafter, portions of lamina of the tobacco leaves thus being cured were cut off as samples. The samples thus obtained were finely cut to 5 mm×5 mm squares. Approximately 10 g of the samples thus cut was collected and put into a 300 ml Erlenmeyer flask. 200 ml of 10 mM phosphate buffer (pH: 7.0) was added thereto, and the mixture was homogenized. The suspensions thus obtained were used as "the curing-time suspensions" containing microorganisms derived from tobacco leaves in the curing period.

In each of the three collections of different time, the collected tobacco leaves were homogenized within 2 hours from sampling.

The harvest-time suspension and the curing-time suspension were diluted with the above-mentioned phosphate buffer, to a concentration at which microorganism can be isolated (specifically, $10^2$ to $10^5$ times), respectively. Each of the diluted suspensions thus obtained was applied, by dropping 0.1 ml a time, on a YG plate (the composition of the culture medium was as follows: 1.0 g of yeast extract; 1.0 g of glucose; 0.3 g of $K_2HPO_4$; 0.2 g of $KH_2PO_4$; 0.2 g of $MgSO_4.7H_2O$; 15.0 g of agar; and an adjusted amount of distilled water to make the total volume of the culture medium 1000 ml, pH 6.8). The microorganism thus applied was cultured at 30° C. for 7 days. After culture, the grown colony was separated into a single colony by using a fresh YG plate. The microorganism thus isolated was stored at −80° C. till used for experiments.

In such a manner as described above, 87 strains of microorganism were isolated from the tobacco leaves of harvest-time and 176 strains of microorganism were isolated from the tobacco leaves that are at the browning stage. The strains having different colony morphology were selected from these collected strains and used for the experiments thereafter.

2) Primary selection of TSNA-degrading microorganism

Among the strains derived from tobacco leaves thus collected in 1), 51 strains in total including 14 strains collected from tobacco leaves at the harvest stage and 37 strains collected from tobacco leaves at the curing stage were selected as the candidate strains for primary selection.

a) Selection of Culture Medium

A culture medium for selecting TSNA-degrading microorganism was examined. By using the strains selected in the aforementioned 1), growth of each strain on a culture medium containing NNN, NNK, NAT and NAB was examined. As a result, the best result was obtained when 1/10 TS broth was used as the basal medium. Accordingly, 1/10 TS broth was used as the basal medium in the subsequent culture. The composition of 1/10 TS broth itself and the composition of the culture medium containing 1/10 TS broth and the microorganism, which was used for culture, are shown below in this order.

[1/10 TS broth]

| | |
|---|---|
| Final volume | adjusted to 1000 ml by adding distilled water |
| Casein | 1.7 g |
| D-glucose | 0.25 g |
| NaCl | 0.5 g |
| $K_2HPO_4$ | 2.5 g |
| 1/10 Tryptic Soy (manufactured by Difco Co., Ltd., Bacto Tryptic Soy Broth; Soybean-Casein Digest Medium) | |

-continued

| [Culture medium for selecting TSNA-degrading microorganism] | |
|---|---|
| Final volume | 35 ml |
| 1/10 TS broth (containing 5 ppm of NNN, 5 ppm of NAT, 5 ppm of NAB and 5 ppm of NNK,) | 30 ml |
| Suspension of microorganism for inoculation | 5 ml |

The aforementioned culture medium for selecting TSNA-degrading microorganism was prepared by the following method. 150 μl of dichloromethane containing 1000 ppm of NNN, 150 μl of dichloromethane containing 1000 ppm of NAT, 150 μl of dichloromethane containing 1000 ppm of NAB and 150 μl of dichloromethane containing 1000 ppm of NNK, were put into an Erlenmeyer flask and then dichloromethane in the flask was completely volatilized. Next, the 1/10 TS broth was added to the flask such that the concentrations of NNN, NAT, NAB and NNK were adjusted to 5 ppm/10 ml, respectively. After NNN, NAT, NAB and NNK were dissolved, 30 ml of the mixture was put into each of 50 ml Erlenmeyer flasks. Next, 5 ml of the suspension of the microorganism for inoculation was added to the 50 ml Erlenmeyer flask, whereby a culture medium for selecting TSNA-degrading microorganism, which had final volume of 35 ml, was obtained. The culture medium was incubated at 30° C. for 24 hours with shaking.

b) Primary selection of the TSNA-degrading microorganism

The primary selection of the TSNA-degrading microorganism was carried out by using the culture medium for selection thus prepared.

The candidate strains for primary selection were each cultured with shaking in the 1/10 TS broth and then the bacterial cells of each strain were collected by centrifuging. The bacterial cells thus collected were washed with sterilized distilled water twice and suspended in sterilized distilled water. Next, the concentration of the microorganism in each suspension was adjusted to $10^8$ to $10^{10}$ cfu/ml with sterilized distilled water, whereby a suspension of each candidate strain was prepared.

Five to 10 strains of the candidate microorganism in a form of suspensions thus obtained, were mixed with each other, wherein the mixed 5 to 10 strains are derived from the same stage of tobacco leaves. Thereby 7 groups of suspension mixtures of the candidate microorganisms were prepared.

These 7 groups of suspension mixtures of the candidate microorganisms were cultured in a manner similar to that of the aforementioned 1) by using the 1/10 TS broth as the culture medium for selecting TSNA-degrading microorganism, except that the above-described 7 groups of suspension mixtures of the candidate microorganisms were employed.

As the control, 5 ml of sterilized distilled water was added in place of the suspension of the candidate microorganisms.

The 7 groups of suspension of the mixed candidate microorganisms and the control group were incubated at 30° C. for 24 hours with shaking.

Thereafter, the contents of the respective TSNA were determined.

The determination of the contents of the respective TSNA was carried out by the following method. Specifically, contents of NNN, NAT, NAB and NNK contained in a sample obtained from each culture medium were each determined by using gas chromatography in accordance with the improved method of Spiegelhalder (Spiegelhalder B., Kubacki S. and Fischer S. (1989) Beitr. Tabakforsch. Int., 14 (3), 135-143, Fischer S. and Spiegelhalder B. (1989) Beitr. Tabakforsch. Int., 14 (3), 145-153).

First, each culture medium was purified by using column chromatography as follows. At first, the whole culture medium was filtrated by using a filter paper (ADVANTEC, No. 5). Then, 10 ml of each filtrate was applied on a column filled with Kieselgur (particle diameter: 60 to 160 mm, manufactured by MERCK Co., Ltd.) and ascorbic acid. A fraction necessary for a sample was collected by dissolving the fraction with dichloromethane. The fraction thus obtained was used as a sample for gas chromatography. The sample thus obtained was analyzed by using gas chromatography HP 6890 (manufactured by Hewlett-Packard Co., Ltd.) equipped with column DB-17 (manufactured by J & W Co. Ltd.) and detector TEA-543 (manufactured by Thermedics Co., Ltd.).

The results of determination of the contents of the respective TSNA in the above-described 7 groups and the control group are shown in Table 1.

TABLE 1

Results of the primary selection

| | NNN | | NAT | | NAB | | NNK | | Total TSNA | |
|---|---|---|---|---|---|---|---|---|---|---|
| Group | μg/10 mL | (%) | μg/10 mL | (%) | μg/10 mL | (%) | μg/10 mL | (%) | μg/10 mL | (%) |
| 1 | 1.34 | 48.13 | 2.40 | 51.95 | 2.04 | 51.54 | 1.37 | 38.29 | 7.16 | 47.87 |
| 2 | 1.96 | 70.26 | 3.03 | 65.39 | 2.96 | 74.62 | 1.77 | 49.48 | 9.71 | 64.95 |
| 3 | 2.16 | 77.59 | 3.76 | 81.33 | 2.92 | 73.56 | 2.48 | 69.50 | 11.32 | 75.75 |
| 4 | 1.89 | 67.98 | 4.27 | 92.26 | 3.98 | 100.26 | 2.81 | 78.71 | 12.95 | 86.62 |
| 5 | 2.92 | 104.71 | 4.07 | 87.97 | 3.72 | 93.68 | 2.99 | 83.64 | 13.69 | 91.57 |
| 6 | 2.43 | 87.25 | 4.36 | 94.13 | 3.86 | 97.19 | 2.76 | 77.34 | 13.40 | 89.65 |
| 7 | 2.33 | 83.46 | 3.71 | 80.12 | 2.97 | 74.77 | 2.38 | 66.71 | 11.38 | 76.12 |
| Control group | 2.79 | | 4.63 | | 3.97 | | 3.57 | | 14.95 | |

Group 1 and Group 2 in Table 1 each represent the suspension mixture of the strains collected from tobacco leaves immediately after harvest. Group 3, Group 4 and Group 5 each represent the suspension mixture of the strains collected from tobacco leaves at the yellowing stage that is the initial stage of the curing process (on day 3 of the curing process). Group 6 and Group 7 each represent the suspension mixture of the strains collected from tobacco leaves at the browning stage (on day 8 of the curing process). In the table, "%" represents the content (%) of the respective TSNA in each group, when the corresponding contents in the control group are expressed as 100%.

As is obvious from Table 1, in all of the groups of the mixture of microorganisms, the contents of TSNA were decreased as compared with the contents of TSNA of the control group. With regard to the total amount of TSNA, in particular, the total amount of TSNA of Group 1 and that of Group 2 were decreased to 47.87% and 64.95%, respectively, as compared with that of the control group (Table 1).

From these results, it was proved that plural types of useful microorganisms which degrade TSNA had been successfully isolated from tobacco leaves.

3) Secondary selection of the TSNA-degrading microorganism

On the basis of the results of the aforementioned 2), Group 1 and Group 2 exhibiting excellent capability to degrade TSNA were further subjected to a test for secondary selection.

For each of the 14 strains of the microorganisms contained in Group 1 and Group 2, the capability to degrade the respective TSNA thereof was tested.

The capability to degrade the respective TSNA, of each of the 14 strains, was tested in a manner similar to that described in the aforementioned 2), except that the number of the type of the microorganism contained in each suspension of microorganism (which each suspension was mixed with the 1/10 TS broth) was limited to one strain selected from the strains of the microorganisms collected in the aforementioned 1).

Each of the determined content values was the average of the values obtained by two repeated determinations.

The results thus obtained are shown in Table 2.

TABLE 2

Capability of each strain to degrade TSNA

| Tested strain | μg/10 mL NNN | NAT | NAB | NNK | TSNA | (%) NNN | NAT | NAB | NNK | TSNA | Group No. |
|---|---|---|---|---|---|---|---|---|---|---|---|
| Not added | 2.21 | 2.61 | 1.95 | 2.10 | 8.87 | | | | | | |
| LG1 | 3.23 | 3.69 | 2.72 | 2.62 | 12.27 | 146.35 | 141.24 | 139.50 | 125.21 | 138.34 | 1 |
| LG2 | 2.32 | 2.48 | 1.84 | 1.43 | 8.06 | 104.75 | 94.79 | 94.59 | 68.01 | 90.90 | 2 |
| LG3 | 2.28 | 2.90 | 2.15 | 2.10 | 9.43 | 102.98 | 110.96 | 110.63 | 100.39 | 106.40 | 2 |
| LG5 | 2.56 | 3.10 | 2.28 | 0.07 | 8.01 | 116.05 | 118.57 | 117.09 | 3.24 | 90.36 | 2 |
| LG9 | 2.33 | 3.27 | 2.37 | 2.06 | 10.02 | 105.42 | 125.00 | 121.54 | 98.09 | 113.00 | 2 |
| LG38 | 1.49 | 1.97 | 1.30 | 1.27 | 6.03 | 67.43 | 75.40 | 66.66 | 60.63 | 68.00 | 1 |
| LG43 | 1.92 | 2.61 | 1.64 | 1.22 | 7.39 | 86.65 | 99.98 | 84.43 | 58.32 | 83.40 | 2 |
| LG44 | 1.76 | 3.02 | 1.89 | 1.85 | 8.52 | 79.66 | 115.54 | 97.07 | 88.51 | 96.15 | 2 |
| LG48 | 1.88 | 2.21 | 1.60 | 1.63 | 7.33 | 85.28 | 84.53 | 82.22 | 78.02 | 82.67 | 2 |
| LG51 | 2.08 | 2.30 | 1.69 | 1.25 | 7.32 | 94.02 | 87.90 | 86.71 | 59.86 | 82.54 | 2 |
| LG52 | 2.67 | 3.45 | 2.58 | 2.41 | 11.12 | 120.98 | 132.18 | 132.60 | 115.07 | 125.44 | 2 |
| LG64 | 3.92 | 4.08 | 2.90 | 3.28 | 14.16 | 177.18 | 156.02 | 148.71 | 156.32 | 159.79 | 1 |
| LG77 | 2.89 | 3.12 | 2.24 | 0.97 | 9.21 | 130.73 | 119.43 | 114.84 | 46.15 | 103.92 | 1 |
| LG81 | 2.91 | 3.48 | 2.48 | 2.86 | 11.73 | 131.53 | 133.36 | 127.47 | 136.44 | 132.34 | 1 |

As is obvious from Table 2, LG38 strain, LG48 strain, LG51 strain and LG43 strain are capable of degrading NNN, NAT, NAB and NNK. LG38 strain, in particular, reduced NNN, NAT, NAB and NNK to 67.43%, 75.40%, 66.66% and 60.63%, respectively. LG38 strain reduced the total TSNA content to 68.00%.

Further, LG2 strain, LG5 strain and LG77 strain are capable of specifically degrading NNK. LG5 strain, in particular, is capable of reducing the NNK content to 3.24%.

On the basis of the above-described results, LG5 strain capable of specifically degrading NNK and LG38 strain capable of specifically degrading the respective TSNA were selected.

The above-described results indicate that TSNA in tobacco leaves can be significantly reduced by treating tobacco leaves with the aforementioned microorganisms. The aforementioned microorganisms were isolated from tobacco leaves, and therefore exhibit excellent stability when placed on tobacco leaves. It is assumed that, because of this capacity to fix on tobacco leaves, the microorganism can exhibit TSNA degrading activity on tobacco leaves in a sufficiently stable manner.

4) Identification of the Microorganism

The bacteriological characteristics of LG5 strain and LG38 strain thus selected are summarized in Table 3 and Table 4.

TABLE 3

Bacteriological characteristics of LG5 strain

| Tested items | Characteristics |
|---|---|
| Shape | Rod |
| Gram's stain | − |
| Spore | − |
| Motility | + |
| Behavior toward oxygen | Aerobic |
| Oxidase | + |
| Catalase | + |
| OF | − |
| Color tone of Colony | Yellowish |
| Reduction of nitrate | − |
| Production of indole | − |
| Fermentation of glucose | − |
| Arginine dihydrolase | − |

TABLE 3-continued

Bacteriological characteristics of LG5 strain

| Tested items | Characteristics |
|---|---|
| Urease | − |
| Degradation of esculin | + |
| Liquefiability of gelatin | − |
| β-galactosidase | − |
| Utilization | |
| Glucose | + |
| L-arabinose | + |
| D-mannose | − |
| D-mannitol | − |
| N-acetyl-D-glucosamine | + |

TABLE 3-continued

| Bacteriological characteristics of LG5 strain | |
|---|---|
| Tested items | Characteristics |
| Maltose | + |
| Potassium gluconate | + |
| n-capric acid | − |
| Adipic acid | − |
| dl-malic acid | + |
| Sodium citrate | − |
| Phenyl acetate | − |

TABLE 4

| Bacteriological characteristics of LG38 strain | |
|---|---|
| Tested items | Characteristics |
| Shape | Rod |
| Gram's stain | − |
| Spore | − |
| Motility | + |
| Behavior toward oxygen | Aerobic |
| Oxidase | + |
| Catalase | + |
| OF | ○ |
| Color tone of Colony | Yellowish |
| Production of fluorescent pigment | − |
| Reduction of nitrate | + |
| Production of indole | − |
| Fermentation of glucose | − |
| Arginine dihydrolase | − |
| Urease | − |
| Degradation of esculin | + |
| Liquefiability of gelatin | − |
| β-galactosidase | − |
| Utilization | |
| Glucose | + |
| L-arabinose | + |
| D-mannose | + |
| D-mannitol | + |
| N-acetyl-D-glucosamine | − |
| Maltose | − |
| Potassium gluconate | + |
| n-capric acid | + |
| Adipic acid | − |
| dl-malic acid | + |
| Sodium citrate | + |
| Phenyl acetate | − |

On the basis of the above-described results, LG5 strain was identified as microorganism which belongs to *Sphingomonas paucimobilis* and LG 38 was identified as microorganism which belongs to *Pseudomonas fluorescens*.

The identification of the aforementioned bacteria was carried out with the help of Japan Food Research Laboratories.

LG5 has been deposited under International Patent Organism Depositary described above with Dec. 18, 2001 (accession number: FERM BP-7830). Similarly, LG38 has been deposited under International Patent Organism Depositary with Dec. 18, 2001 (accession number: FERM BP-7831).

Example 2

Decrease in TSNA Content in Curing process by the treatment with LG38 strain

LG38 strain was inoculated into the 1/10 TS broth and cultured at 30° C. for 72 hours. After the culture, the culture medium containing the bacterial cells was subjected to centrifuging at 5000 rpm, so that the bacterial cells were separated and collected. The bacterial cells thus collected were washed with sterilized distilled water twice and suspended in sterilized distilled water. The concentration of the microorganism in the suspension was adjusted to $10^8$ to $10^{10}$ cfu/ml by diluting the suspension with sterilized distilled water.

Tobacco leaves of Burley variety (Kitakami 1) which had been harvested and brought into the curing process were treated with the suspension of the microorganism in which the concentration of the microorganism had been thus adjusted to a predetermined concentration. The treatment was carried out three times, i.e., immediately after the harvest, 3 days after the harvest, and 8 days after the harvest. In each treatment, the suspension was sprayed on front and back surfaces of tobacco leaves by a spray such that 10 ml thereof was sprayed per one piece of tobacco leaf.

The tobacco leaves thus treated were cured by using a steel pipe house. The tobacco leaves were collected on day 10 and day 21 in the curing process. The tobacco leaves thus collected were cut so as to be separated to laminas and stems. Then the laminas and the stems were homogenized by using a mixer. The lamina portion was used for determining the TSNA content.

The determination of the main four types of TSNA (NNN, NNK, NAT and NAB) was carried out in a manner similar to that described in the aforementioned 2).

The total TSNA content was expressed as the total of the respective contents of the main four types of TSNA (NNN, NNK, NAT and NAB). The results are shown in Table 5.

TABLE 5

| Content of TSNA (μg/g) | | | |
|---|---|---|---|
| | Time (days) after harvest | | |
| Treatment | Day 0 | Day 10 | Day 21 |
| Not treated (Control) | 0.53 | 0.98 | 3.01 |
| Water treated | 0.53 | 3.48 | 3.45 |
| LG38 strain treated | 0.53 | 1.09 | 2.76 |

The group treated with water in Table 5 represents a group which was treated with only water containing no bacterial cells in each treatment.

From Table 5, it is known that the content of TSNA increased with the lapse of time in all of the groups and that such an increase in the content of TSNA was particularly significant in the group treated with water. When the group treated with LG38 strain is compared with the group which received no treatment, the former exhibited lower TSNA content on day 21 than the latter.

These results indicate that LG38 strain is capable of reducing the TSNA content.

Further, an effect of nitrite(-nitrogen) content on the treatment with LG38 was also investigated.

Determination of the nitrite-nitrogen content of tobacco leaves treated as described above was carried out. The method of determination will be described hereinafter.

First, 0.5 g of lamina was collected from tobacco leaves of each group and placed in a 50 ml centrifuge tube. Next, 25 ml of an extraction solution described below was added thereto. The mixture was agitated for 30 minutes and then nitrite was extracted. The extract was filtrated by using a filter paper (ADVANTEC, No. 1). 10 ml of the filtrate was collected, 0.5 g of activated carbon was added thereto, and the mixture was agitated for 15 minutes. Thereafter, the activated carbon was removed by using a filter paper (ADVANTEC, No. 5). The filtrate thus obtained was used as a sample for determining the content of nitrite-nitrogen.

| Extraction solution: | |
|---|---|
| KCl | (1% KCl) |
| Sulfanylamide | (0.5% sulfanylamide) |
| Triton X-100 | (0.1% Triton X-100) |

In the determination of the content of nitrite-nitrogen in the extract, an autoanalyzer (manufactured by BRAN+LUEBBE Co., Ltd., AACSII) was used and the content of nitrite-nitrogen was obtained by converting the transmittance of the filter at 550 nm to the content of nitrite-nitrogen. For coloring nitrite-nitrogen, 1% of sulfanylamide and 0.1% of N-naphthylethylenediamine dihydrochloride were used. The results are shown in Table 6.

TABLE 6

| Content of nitrite-nitrogen ($NO_2$—N) (μg/g) | | |
|---|---|---|
| | Time (days) after harvest | |
| Treatment | Day 0 | Day 10 |
| Not treated (Control) | 0.71 | 1.25 |
| Water treated | 0.71 | 3.29 |
| LG38 strain treated | 0.71 | 1.20 |

As is obvious from Table 6, the content of nitrite-nitrogen which is a material in formation of TSNA was significantly increased in the group treated with water on day 10 in the curing process. In contrast, when the group treated with LG38 strain is compared with the group which received no treatment, the content of nitrite-nitrogen of the former was slightly lower than that of the latter on day 10 in the curing process.

LG38 strain was identified, on the basis of the bacteriological characteristics thereof, as a strain which is capable of reducing nitrate. However, the above-described results indicate, as compared with the group which received no treatment, that LG38 strain rather suppresses reduction of nitrate to nitrite.

Example 3

Effect of the Treatment with LG5 Strain on the Content of NNK

The content of NNK was determined in a manner similar to that described in Example 2, except that the microorganism used in the method of Example 2 was replaced with LG5.

The results are shown in Table 7.

TABLE 7

| Content of NNK (μg/g) | | | |
|---|---|---|---|
| | Time (days) after harvest | | |
| Treatment | Day 10 | Day 21 | Day 32 |
| Not treated (Control) | 0.15 | 0.52 | 0.29 |

TABLE 7-continued

| Content of NNK (μg/g) | | | |
|---|---|---|---|
| | Time (days) after harvest | | |
| Treatment | Day 10 | Day 21 | Day 32 |
| Water treated | 0.71 | 0.61 | 0.32 |
| LG5 strain treated | 0.59 | 0.78 | 0.22 |

As is obvious from Table 7, in the group which received no treatment, the NNK content was increased until day 21 but the NNK content on day 32 (when the curing process was completed) was lower than that of day 21. In both of the group treated with water and the group treated with LG5 strain, the NNK content was relatively high until day 21, but the NNK content on day 32 was lower than that of day 21 as in the case of the group which received no treatment. When the group treated with LG5 strain is compared with the group which received no treatment, the NNK content on day 32 of the former was slightly lower than that of the latter. These results indicate that LG 5 strain is capable of reducing the NNK content.

It should be noted that the entire contents of all of the documents referred to in this specification are incorporated herein by reference.

Further advantages and modifications of the present invention will easily be contrived by one skilled in the art. The present invention which may be defined by such a larger scope is not restricted by the specific and representative aspects of the invention shown and described above. Thus, various modifications will be possible to the present invention without departing from the spirit and the scope of the comprehensive invention idea as defined by the accompanying claims and equivalents thereof.

Example 4

Effect of the Treatment with the TSNA-degrading bacterium on the TSNA Content in powder of tobacco leaf LG5 strain and LG38 strain were inoculated on the 1/10 TS broth, respectively, and cultured at 30° C. for 72 hours. Each of the culture media containing the bacterial cells was subjected to centrifuging at 5000 rpm, so that the bacterial cells were collected. The bacterial cells was washed with sterilized distilled water twice and suspended in sterilized distilled water. The concentration of bacterial cells of each suspension was adjusted to $10^8$ to $10^9$ cfu/ml, whereby the suspension of the microorganism as inoculum was obtained.

In the experiment of LG5 strain, freeze-dried powder of the cutters, of tobacco plants (variety: Kitakami 1) grown in Leaf Tobacco Research Center (Oyama-shi, Tochigi prefecture) of Japan Tobacco Inc, was used. In the experiment of LG38 strain, freeze-dried powder of the leaf stalk position of the same tobacco plants as described above was used.

Each of the respective types of tobacco powder was put, by a measured amount, in a mortar, and the suspension of the microorganism was added thereto such that the moisture content of the mixture reached a predetermined value. The mixture was mixed with a pestle so that the powder exhibited even distribution of the moisture content. The powder thus obtained was put, by a measured amount, in an Erlenmeyer flask, and left still at a predetermined temperature.

The analysis was carried out for a sample taken from the tobacco powder prior to the aforementioned treatment with the microorganism and a sample taken from the tobacco powder which had been left still for four weeks after the treatment, respectively. 5 g of each of the samples was put into a 200 ml Erlenmeyer flask, 100 ml of 0.01 M NaOH aqueous solution (containing Thimerosal by 100 μg/ml) was added thereto, and the extraction was carried out for 2 hours at the room temperature by using an agitator. Thereafter, the extract was filtrated with a filter paper (ADVANTEC Co., Ltd., No. 5C).

Next, NNN, NNK, NAT and NAB were analyzed by the method described in Example 1.

The TSNA contents prior to the treatment with the microorganism and those four weeks after the treatment are shown in Table 8 and Table 9.

TABLE 8

Change in TSNA contents in powder of tobacco leaves caused by the treatment with LG38 strain

| Treatment | Tested strain | Moisture content (%) | Treatment temperature (° C.) | Prior to the treatment NNN (μg/g) | Prior to the treatment NAT (μg/g) | Prior to the treatment TSNA (μg/g) |
|---|---|---|---|---|---|---|
| 1 | LG38 | 20 | 20 | 4.87 | 2.92 | 7.79 |
| 2 | LG38 | 20 | 30 | 4.87 | 2.92 | 7.79 |
| 3 | LG38 | 40 | 20 | 4.87 | 2.92 | 7.79 |
| 4 | LG38 | 40 | 30 | 4.87 | 2.92 | 7.79 |

| Treatment | 4 weeks after the treatment NNN (μg/g) | 4 weeks after the treatment NAT (μg/g) | 4 weeks after the treatment TSNA (μg/g) | Change in NNN content (after the treatment - before the treatment) (μg/g) | Change in NAT content (after the treatment - before the treatment) (μg/g) | Change in TSNA content (after the treatment - before the treatment) (μg/g) |
|---|---|---|---|---|---|---|
| 1 | 4.80 | 2.91 | 7.71 | −0.07 | −0.01 | −0.08 |
| 2 | 4.67 | 2.55 | 7.22 | −0.20 | −0.37 | −0.57 |
| 3 | 3.93 | 2.65 | 6.58 | −0.94 | −0.27 | −1.21 |
| 4 | 3.46 | 2.61 | 6.07 | −1.41 | −0.31 | −1.72 |

* NAB and NNK content values are not shown because these values were below the detection limit.

TABLE 9

Change in NNK content in powder of tobacco leaves caused by the treatment with LG5 strain

| Treatment | Tested strain | Moisture content (%) | Treatment temperature (° C.) | Prior to the treatment NNK (μg/g) | 4 weeks after the treatment NNK (μg/g) | Change in NNK content (after the treatment - before the treatment) (μg/g) |
|---|---|---|---|---|---|---|
| 1 | LG5 | 20 | 20 | 0.90 | 0.63 | −0.27 |
| 2 | LG5 | 20 | 30 | 0.90 | 0.33 | −0.57 |
| 3 | LG5 | 40 | 20 | 0.90 | 0.00 | −0.90 |
| 4 | LG5 | 40 | 30 | 0.90 | 0.21 | −0.69 |

* NAB content value is not shown because it was below the detection limit.

From the experiments described above, it has been proved that LG5 strain specifically degrades NNK, and LG38 strain degrades NNN, NAT, NAB and NNK.

The NNK content in the powder of the cutters of tobacco plants, was decreased four weeks after the treatment with LG5 strain, as compared with that prior to the treatment. When the NNN and NAT contents in the powder of the leaf stalk position of tobacco plants, four weeks after the treatment with LG38 strain were compared with those prior to the treatment, the NNN and NAT contents were both decreased in all of the treated groups. That is, in the experiments in which tobacco powder was tested, LG5 strain degraded NNK and LG38 strain degraded NNN and NAT in a manner similar to that observed in the aforementioned experiments.

Example 5

Effect of the treatment with the TSNA-degrading bacterium on the TSNA content of tobacco leaves in storage LG38 strain was inoculated into 1/10 TS broth and cultured at 30° C. for 72 hours. After the culture, the culture medium containing the bacterial cells was subjected to centrifuging at 5000 rpm, so that the bacterial cells were collected. The bacterial cells thus collected were washed with sterilized distilled water twice and suspended in sterilized distilled water. The concentration of bacterial cells in the suspension was adjusted to $10^8$ to $10^9$ cfu/ml, whereby the suspension of the microorganism as inoculum was obtained.

The suspension of the microorganism thus prepared as the inoculum was sprayed on front and back surfaces of tobacco leaves of Burley tobacco which were in the curing process in a steel pipe house (at the final stage of drying stems of leaves, day 29, variety: Kitakami 1) such that 10 ml of the suspension was sprayed per one piece of leaf. The tobacco leaves thus treated were further cured for 3 days in the steel pipe house and then used for the storage test.

Collection of samples to be analyzed: Prior to starting storage of the tobacco leaves, the half-leaf laminas of the cured tobacco leaves taken from the steel pipe house were collected as the sample prior to the treatment. The remaining half-leaf laminas with stems were stored. The storage was carried out under the predetermined conditions in which temperature and humidity were each kept constant. With regard to the storage conditions, three groups: temperature 20° and humidity 70%; temperature 20 and humidity 80%; and temperature 30 and humidity 80%, were set, respectively. Sampling was carried out one month and three months after the starting of the storage. The cured tobacco leaves were stored in the same conditions as described above without treating the tobacco leaves with the microorganism, and the obtained tobacco leaves were used as the sample of the control group. The tobacco leaves thus sampled were separated to laminas and stems and then freeze-dried sample of laminas was grounded by using a mixer. Only the sample of laminas was used for determining the TSNA content.

Approximately 5 g of the lamina sample of each of the groups treated as described above was put into a 200 ml Erlenmeyer flask, 100 ml of 0.01 M NaOH aqueous solution (containing Thimerosal by 100 μg/ml) was added thereto, and the extraction was carried out for 2 hours at the room temperature by using an agitator. Thereafter, the extract was filtrated with a filter paper (ADVANTEC Co., Ltd., No. 5C).

NNN, NNK, NAT and NAB were analyzed by the method described in Example 1.

The results are shown in Table 10.

TABLE 10

Change in TSNA content in tobacco leaves in storage caused by the treatment with the microorganism

| Treatment | Storage temperature (° C.) | Storage humidity (%) | At the time of starting storage NNN (μg/g) | NAT (μg/g) | NAB (μg/g) | NNK (μg/g) | TSNA (μg/g) | One month after storage NNN (μg/g) | NAT (μg/g) | NAB (μg/g) | NNK (μg/g) | TSNA (μg/g) |
|---|---|---|---|---|---|---|---|---|---|---|---|---|
| Not treated | 20 | 70 | 0.62 | 1.63 | 0.00 | 0.18 | 2.43 | 0.64 | 1.79 | 0.00 | 0.03 | 2.46 |
| Not treated | 20 | 70 | 1.37 | 3.32 | 0.05 | 0.37 | 5.11 | | | | | |
| Not treated | 30 | 70 | 0.86 | 1.71 | 0.00 | 0.13 | 2.70 | 0.98 | 1.92 | 0.00 | 0.00 | 2.90 |
| Not treated | 30 | 70 | 0.51 | 1.44 | 0.01 | 0.21 | 2.17 | | | | | |
| Not treated | 30 | 80 | 0.84 | 1.69 | 0.00 | 0.13 | 2.66 | 0.92 | 1.65 | 0.00 | 0.00 | 2.57 |
| Not treated | 30 | 80 | 0.95 | 2.09 | 0.00 | 0.16 | 3.20 | | | | | |
| LG38 | 20 | 70 | 0.51 | 1.08 | 0.00 | 0.09 | 1.68 | 0.45 | 0.94 | 0.00 | 0.03 | 1.42 |
| LG38 | 20 | 70 | 1.07 | 2.27 | 0.00 | 0.14 | 3.48 | | | | | |
| LG38 | 30 | 70 | 0.62 | 1.36 | 0.00 | 0.11 | 2.09 | 0.55 | 1.20 | 0.00 | 0.00 | 1.75 |
| LG38 | 30 | 70 | 1.01 | 1.40 | 0.00 | 0.14 | 2.55 | | | | | |
| LG38 | 30 | 80 | 0.54 | 1.24 | 0.00 | 0.14 | 1.92 | 0.52 | 1.18 | 0.00 | 0.00 | 1.70 |
| LG38 | 30 | 80 | 0.49 | 1.19 | 0.00 | 0.09 | 1.77 | | | | | |

| Treatment | Change in TSNA content (after 1 month storage - before storage) (μg/g) | Three months after storage NNN (μg/g) | NAT (μg/g) | NAB (μg/g) | NNK (μg/g) | TSNA (μg/g) | Change in TSNA content (after 3 months storage - before storage) (μg/g) |
|---|---|---|---|---|---|---|---|
| Not treated | 0.03 | | | | | | |
| Not treated | | 1.52 | 3.55 | 0.07 | 0.00 | 5.14 | 0.03 |
| Not treated | 0.20 | | | | | | |
| Not treated | | 0.98 | 2.94 | 0.04 | 0.00 | 3.96 | 1.79 |
| Not treated | −0.09 | | | | | | |
| Not treated | | 2.01 | 2.22 | 0.02 | 0.00 | 4.25 | 1.05 |
| LG38 | −0.26 | | | | | | |
| LG38 | | 1.08 | 2.13 | 0.00 | 0.00 | 3.21 | −0.27 |
| LG38 | −0.34 | | | | | | |
| LG38 | | 1.19 | 1.42 | 0.00 | 0.00 | 2.61 | 0.06 |
| LG38 | −0.22 | | | | | | |
| LG38 | | 0.60 | 1.06 | 0.00 | 0.00 | 1.66 | −0.11 |

In the no treatment groups, one month after the storage, the TSNA content was increased in "20° C.-70% group" and "30° C.-70% group". In the no treatment groups, three months after the storage, the TSNA content was significantly increased in "30° C.-70% group" and "30° C.-80% group", in particular. In the groups treated with LG38 strain, there was observed a tendency that the TSNA content was decreased both after one month and after three months. In the groups treated with LG38 strain, the TSNA content was significantly decreased one month after the storage, in particular.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A method of reducing the content of Tobacco Specific Nitrosamines (TSNA) in a tobacco leaf, comprising:

1) applying an isolated microorganism of *Sphingornonas paucimobilis* LG5 strain (FERM BP-7830) which has the capability to reduce TSNA to a tobacco leaf by any one of the following treatments i) to iii), in a period from the time after harvest of the tobacco leaf to the time when completing a storage process, to produce a treated tobacco leaf:

i) at least one time of spraying of a liquid suspension or a dry powder comprising the isolated microorganism;

ii) at least one time of coating of the liquid suspension or the dry powder comprising the isolated microorganism; and iii) at least one time of immersion in the liquid suspension comprising the isolated microorganism, and 2) curing the treated tobacco leaf wherein a cured tobacco leaf has a lower TSNA content as compared with an untreated tobacco leaf.

2. The method according to claim 1, wherein said microorganism is applied in a period from the time when starting a curing process to the time when completing a storage process.

3. The method according to claim 1, wherein the TSNA is at least one type of TSNA selected from the group consisting of N'-nitrosonornicotine, 4-(N-nitrosomethylamino)-1-(3-pyridyl)- 1 -butanone, N'-nitrosoanatabine and N'-nitrosoanabasine.

4. The method of reducing the content of TSNA in a tobacco leaf according to claim 1, wherein The curing step is an air-curing step.

5. The method according to claim 1, wherein said liquid suspension has a concentration of said microorganism of $10^7$ to $10^{12}$ cells/ml.

6. The method according to claim 1, wherein The volume of said liquid suspension is 0.5 to 10 ml per one piece of tobacco leaf

7. The method according to claim 1, wherein said microorganism is applied as a dry powder.

8. The method according to claim 1, wherein air-cured tobacco is sprayed with a liquid suspension or coated with a dry powder formulation at the browning stage of the curing process.

9. The method of reducing the content of TSNA in a tobacco leaf according to claim 2, wherein the curing step is an air-curing step.

* * * * *